US011398212B2

(12) United States Patent
Hsiao et al.

(10) Patent No.: US 11,398,212 B2
(45) Date of Patent: Jul. 26, 2022

(54) INTELLIGENT ACCOMPANIMENT GENERATING SYSTEM AND METHOD OF ASSISTING A USER TO PLAY AN INSTRUMENT IN A SYSTEM

(71) Applicant: Positive Grid LLC, Henderson, NV (US)

(72) Inventors: Fang-Chien Hsiao, Taipei (TW); Yi-Fan Yeh, Taipei (TW); Yi-Song Siao, Taipei (TW); Mu-Chiao Chiu, Taipei (TW)

(73) Assignee: POSITIVE GRID LLC, Henderson, NV (US)

( * ) Notice: Subject to any disclaimer, the term of this patent is extended or adjusted under 35 U.S.C. 154(b) by 122 days.

(21) Appl. No.: 16/984,565

(22) Filed: Aug. 4, 2020

(65) Prior Publication Data

US 2022/0044666 A1 Feb. 10, 2022

(51) Int. Cl.
*G10H 1/38* (2006.01)
*G10H 1/36* (2006.01)
(Continued)

(52) U.S. Cl.
CPC ..... *G10H 1/383* (2013.01); *G10H 1/0016* (2013.01); *G10H 1/10* (2013.01); *G10H 1/365* (2013.01);
(Continued)

(58) Field of Classification Search
CPC ..... G10H 2210/066; G10H 2210/076; G10H 2210/091; G10H 2210/081; G10H 1/365;
(Continued)

(56) References Cited

U.S. PATENT DOCUMENTS 4,457,203 A * 7/1984 Schoenberg ..... G10G 7/02 324/76.47
9,158,760 B2 * 10/2015 Neuhauser ..... G06F 40/40
(Continued)

FOREIGN PATENT DOCUMENTS

EP 1065651 B1 * 3/2016 ..... G10H 1/36
WO WO-8200379 A1 * 2/1982
WO WO-2016009444 A2 * 1/2016 ..... G10H 1/366
WO WO-2020249870 A1 * 12/2020 ..... G10H 1/0008

*Primary Examiner* — Marlon T Fletcher
(74) *Attorney, Agent, or Firm* — Volpe Koenig

(57) ABSTRACT

The intelligent accompaniment generating system includes an input module, an analysis module, a generation module and a musical equipment. The input module is configured to receive a musical pattern signal derived from a raw signal. The analysis module is configured to analyze the musical pattern signal to extract a set of audio features, wherein the input module is configured to transmit the musical pattern signal to the analysis module. The generation module is configured to obtain a playing assistance information having an accompaniment pattern from the analysis module, wherein the accompaniment pattern has at least two parts having different onsets therebetween, and each onsets of the at least two parts is generated by an algorithm according to the set of audio features. The musical equipment includes a digital amplifier configured to output an accompaniment signal according to the accompaniment pattern.

19 Claims, 6 Drawing Sheets

(51) Int. Cl.
*G10H 1/10* (2006.01)
*G10H 1/00* (2006.01)

(52) U.S. Cl.
CPC . *G10H 2210/011* (2013.01); *G10H 2210/036* (2013.01); *G10H 2210/041* (2013.01); *G10H 2210/076* (2013.01)

(58) Field of Classification Search
CPC ..... G10H 2240/145; G10H 1/40; G10H 1/36; G10H 2210/056; G10H 3/125; G10H 2210/155; G10H 2240/135; G10H 2210/005; G10H 7/02; G10H 2240/121; G10H 2220/211; G10H 2210/265; G10H 2210/375; G10H 1/38
See application file for complete search history.

(56) References Cited

U.S. PATENT DOCUMENTS

| | | | | |
|---|---|---|---|---|
| 9,195,649 | B2 * | 11/2015 | Neuhauser | G10H 1/40 |
| 9,318,086 | B1 * | 4/2016 | Miller | G10H 1/057 |
| 10,453,435 | B2 * | 10/2019 | Nariyama | G10L 25/51 |
| 10,887,033 | B1 * | 1/2021 | Tessmann | G10H 1/0008 |
| 2008/0188967 | A1 * | 8/2008 | Taub | G10H 1/00 700/94 |
| 2012/0174737 | A1 * | 7/2012 | Risan | G10H 7/00 84/622 |
| 2019/0012995 | A1 * | 1/2019 | Lupini | G10H 1/40 |
| 2021/0096810 | A1 * | 4/2021 | Kim | G10H 1/0008 |
| 2021/0125592 | A1 * | 4/2021 | Rein | G06N 20/00 |
| 2021/0152908 | A1 * | 5/2021 | Aviv | G10H 3/186 |

* cited by examiner

INTELLIGENT ACCOMPANIMENT GENERATING SYSTEM AND METHOD OF ASSISTING A USER TO PLAY AN INSTRUMENT IN A SYSTEM

TECHNICAL FIELD

Embodiments of the present disclosure are related to an assistance device for a music accompaniment and method thereof, and more particularly, are related to an intelligent accompaniment generating system and method for assisting a user to play an instrument in a system.

BACKGROUND

Due to the development of technology and the advancement of computing technology, a musical instrument having a built-in ADC can convert an analog audio to a digitized signal for processing nowadays. Generally, a musical melody and its accompaniment need musicians to cooperate with each other to play, or a singer sings the main melody and the accompaniment is played by the other musicians. With the assistance of at least one of digitized software and hardware, a user need only play a melody, and its accompaniment can be generated accordingly.

However, the musical accompaniment generated will be stiff or dull without changes, and it can only repeat the notes and melodies that it was given i.e., if the user only plays a few notes, the accompaniment generated will merely corresponds to those notes.

In addition, when the user tries to learn or imitate the accompaniment listened to on a website, the user may like to know a chord information and the effect settings that the digitized software or hardware is applying to the instrument, so that the user can learn the technique for playing the original accompaniment efficiently and precisely.

Therefore, it is expected that a device, a system or a method that can provide solutions to the abovementioned insufficiencies would have commercial potential.

SUMMARY OF INVENTION

In view of the drawbacks in the above-mentioned prior art, the present invention proposes an intelligent accompaniment generating system and method for assisting a user to play an instrument in a system.

The system can be a cloud system including various electronic devices to communicate with each other, and the electronic devices can convert an acoustic audio signal into digitized data, and transfer the digitized data to the cloud system for analyzing. For example, the electronic devices include a mobile device, a musical equipment and a computing device. By means of machine learning, deep learning, big data, a set of audio feature analysis, the cloud system can analyze these data, generates at least one of a visual and an audio assistance information for the user by using at least one of a database generation method, a rule base generation method and a machine learning generation algorithm (or an artificial intelligence (AI) method), wherein the accompaniment includes at least one of a beat pattern and a chord pattern.

In accordance with one embodiment of the present disclosure, an intelligent accompaniment generating system is provided. The intelligent accompaniment generating system includes an input module, an analysis module, a generation module and a musical equipment. The input module is configured to receive a musical pattern signal derived from a raw signal. The analysis module is configured to analyze the musical pattern signal to extract a set of audio features, wherein the input module is configured to transmit the musical pattern signal to the analysis module. The generation module is configured to obtain a playing assistance information having an accompaniment pattern from the analysis module, wherein the accompaniment pattern has at least two parts having different onsets therebetween, and each onsets of the at least two parts is generated by an algorithm according to the set of audio features. The musical equipment includes a digital amplifier configured to output an accompaniment signal according to the accompaniment pattern.

In accordance with another embodiment of the present disclosure, a method for assisting a user to play an instrument in a system is provided. The system includes an input module, an analysis module, a generating module, an output module and a musical equipment having a computing unit, a digital amplifier and a speaker. The method includes steps of: receiving an instrument signal by the input module; analyzing an audio signal to extract a set of audio features by the analysis module, wherein the audio signal includes one of the instrument signal and a musical signal from a resource; generating a playing assistance information according to the set of audio features by the generating module; processing the instrument signal with a DSP algorithm to simulate amps and effects of bass or guitar on the instrument signal to form a processed instrument signal by the computing unit; amplifying the processed instrument signal by the digital amplifier; amplifying at least one of the processed instrument signal and the musical signal by the speaker; and outputting the playing assistance information by the output module to the user.

In accordance with a further embodiment of the present disclosure, a method for assisting a user to play an instrument in an accompaniment generating system is provided. The accompaniment generating system includes a cloud system. The method includes steps of: receiving a musical pattern signal derived from a raw signal; analyzing the musical pattern signal to extract a set of audio features; generating an accompaniment pattern in the cloud system according to the set of audio features; obtaining a playing assistance information including the accompaniment pattern from the cloud system; obtaining an accompaniment signal according to the accompaniment pattern; amplifying the accompaniment signal by a digital amplifier; and outputting the amplified accompaniment signal by a speaker.

The above embodiments and advantages of the present invention will become more readily apparent to those ordinarily skilled in the art after reviewing the following detailed descriptions and accompanying drawings:

DETAILED DESCRIPTION OF THE PREFERRED EMBODIMENTS

Please refer to all Figs. of the present invention when reading the following detailed description, wherein all Figs. of the present invention demonstrate different embodiments of the present invention by showing examples, and help the skilled person in the art to understand how to implement the present invention. The present examples provide sufficient embodiments to demonstrate the spirit of the present invention, each embodiment does not conflict with the others, and new embodiments can be implemented through an arbitrary combination thereof, i.e., the present invention is not restricted to the embodiments disclosed in the present specification.

Figure 1A:
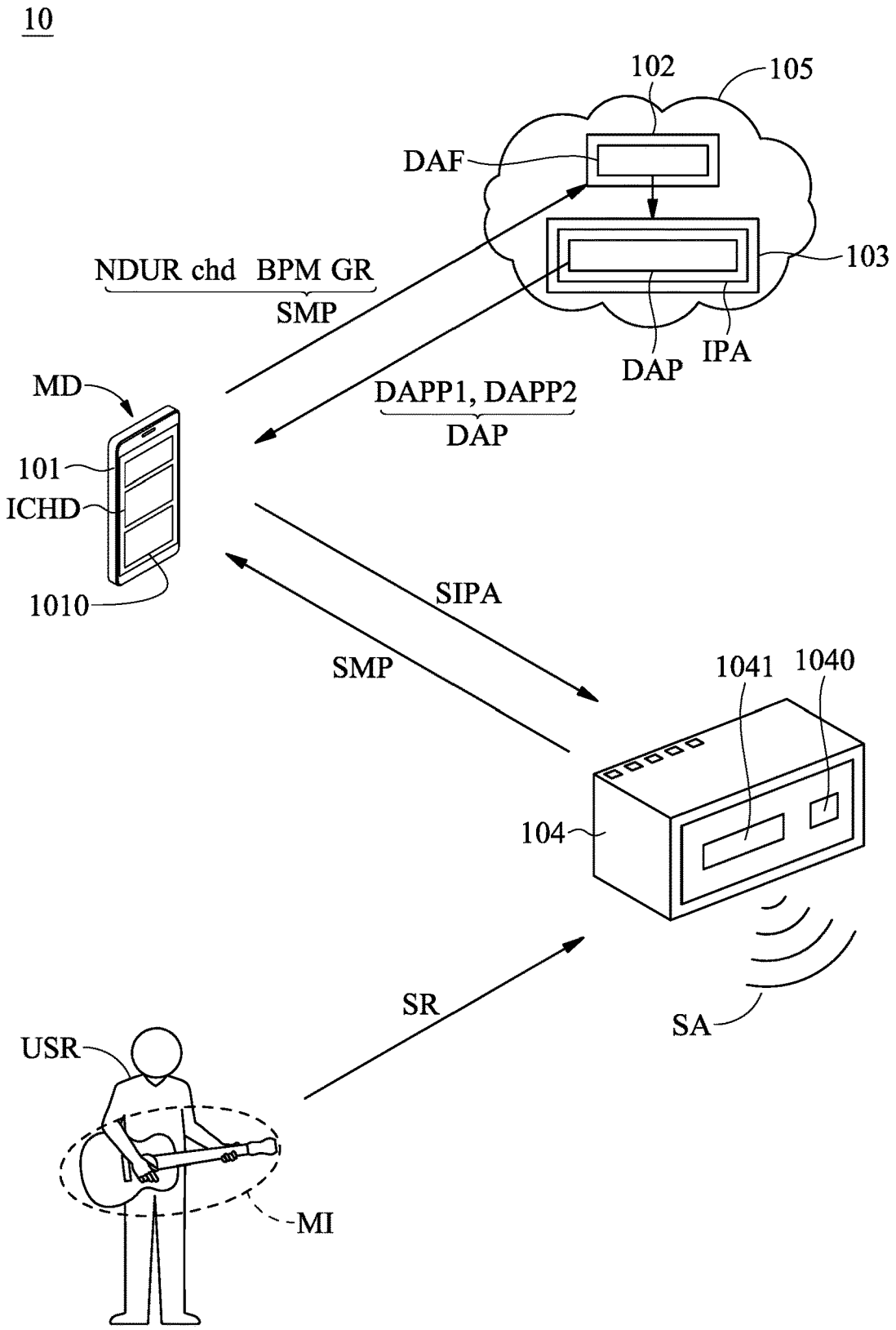
FIG. 1A is a schematic configuration diagram showing an intelligent accompaniment generating system according to a preferred embodiment of the present disclosure.

Please refer to FIG. 1A, which is a schematic diagram showing an intelligent accompaniment generating system 10 according to a preferred embodiment of the present disclosure. The intelligent accompaniment generating system 10 includes an input module 101, an analysis module 102, a generation module 103 and a musical equipment 104. The input module 101 is configured to receive a musical pattern signal SMP derived from a raw signal SR. The analysis module 102 is configured to analyze the musical pattern signal SMP to extract a set of audio features DAF, wherein the input module 101 is configured to transmit the musical pattern signal SMP to the analysis module 102. The generation module 103 is configured to obtain a playing assistance information IPA having an accompaniment pattern DAP from the analysis module 102, wherein the accompaniment pattern DAP has at least two parts DAPP1, DAPP2 having different onsets therebetween, and each onsets of the at least two parts DAPP1, DAPP2 is generated according to the set of audio features DAF. Where the at least two parts DAPP1, DAPP2 can be generated by distinct algorithms or different parameters derived from the set of audio features DAF. The musical equipment 104 includes a digital amplifier 1041, which is configured to output an accompaniment signal SA according to the accompaniment pattern DAP.

Figure 1B:
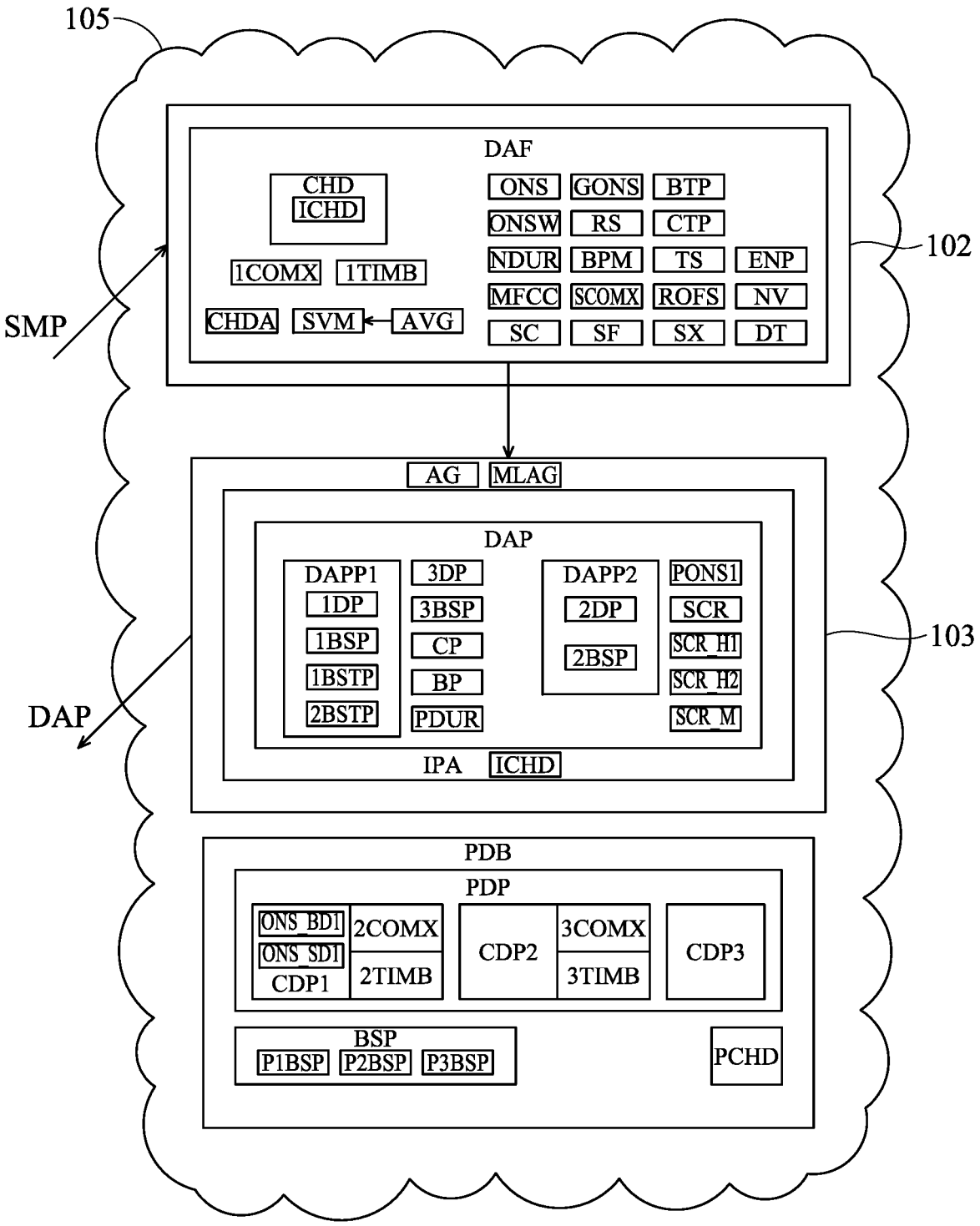
FIG. 1B is a schematic configuration diagram showing details of the analysis and generation modules according to a preferred embodiment of the present disclosure.

Please further refer to FIG. 1B, which is a schematic diagram showing details of the analysis and generation modules 102, 103 according to a preferred embodiment of the present disclosure. In any one of the embodiments of the present disclosure, the accompaniment pattern DAP is outputted by the generation module 103 and is generated according to onsets ONS and chord information CHD of the set of audio features DAF. For example, the accompaniment pattern DAP is outputted by the generation module 103 and is generated by the algorithm AG according to onsets ONS and chord information CHD of the set of audio features DAF. The onset ONS is a starting timing point of a note, and the chord information includes a chord name, a finger chart, a chord timing point, etc. The playing assistance information IPA includes the accompaniment pattern DAP and a chord indicating information ICHD, wherein the accompaniment pattern DAP has a beat pattern BP, and the chord indicating information ICHD is derived from the chord information CHD. The playing assistance information IPA can be transform to a digital playing assistance information signal SIPA, received by the mobile device MD or the musical equipment 104.

In any one of the embodiments of the present disclosure, the input module 101 is implemented on a mobile device MD or the musical equipment 104 for receiving the musical pattern signal SMP, and the musical equipment 104 is connected to at least one of the mobile device MD and a musical instrument MI, wherein the musical pattern signal SMP is derived from a raw signal SR of the musical instrument MI played by a user USR. The analysis module 102 and the generating module can be implemented in a cloud system 105. In some embodiments, the analysis module 102 can be implemented in the input module 101 or the musical equipment 104, and the generating module 104 can be implemented in the input module 101 or the musical equipment 104 as well. If the musical equipment 104 has a network component or module, it can record and transmit the musical pattern signal SMP to the analysis module 102 without the mobile device MD. The network component or module may carry out at least one of Bluetooth®, Wi-Fi and mobile network connections.

In any one of the embodiments of the present disclosure, the analysis module 102 obtains at least one of a beat per minute BPM and a genre information GR from the musical pattern signal SMP, or automatically detects the at least one of the bpm BPM and the genre GR of the musical pattern signal SMP by the analysis module 102. The musical pattern signal SMP is compressed into a compressed musical pattern signal with a compressed format so as to be transmitted to a cloud system 105 including the analysis module 102 and the generation module 103. The mobile device MD or the musical equipment 104 includes a timbre source database 1010, 1040, and receives the accompaniment pattern DAP to call at least one of timbre in the timbre database 1010, 1040 to play, and the at least one of timbre is sounded by the musical equipment 104.

In any one of the embodiments of the present disclosure, the analysis module 102 detects a beat per minute BPM and a time signature in the set of audio features DAF, detects a global onset of the musical pattern signal SMP to exclude a redundant sound RS before the global onset GONS, calculates a beat timing point BTP of each measure of the accompaniment pattern DAP according to the bpm BPM and the time signature TS, and the analysis module 102 determines a chord chd used in the musical pattern signal SMP and a chord timing point CTP according to the chord information CHD and a chord algorithm CHDA. The global onset GONS is a starting timing point of an entire melody played by the user USR.

In any one of the embodiments of the present disclosure, the analysis module 102 obtains the set of audio features DAF including at least one of an entropy ENP, onsets ONS, onset weights ONSW of the onsets ONS, a mel-frequency cepstral coefficients of a spectrum (mfcc), a spectral complexity, a roll off frequency of a spectrum, a spectral centroid, a spectral flatness, a spectral flux and a danceability, wherein each of the onset weights ONSW is calculated by a corresponding note volume NV and a corresponding note duration NDUR of the musical pattern signal SMP.

In any one of the embodiments of the present disclosure, the analysis module 102 calculates an average value AVG of each of the set of audio features DAF in each measure of the musical pattern signal SMP. The analysis module 102 determines the first complexity 1COMX and the first timbre 1TIMB by inputting the average value AVG into a support vector machine model SVM.

Figure 2:
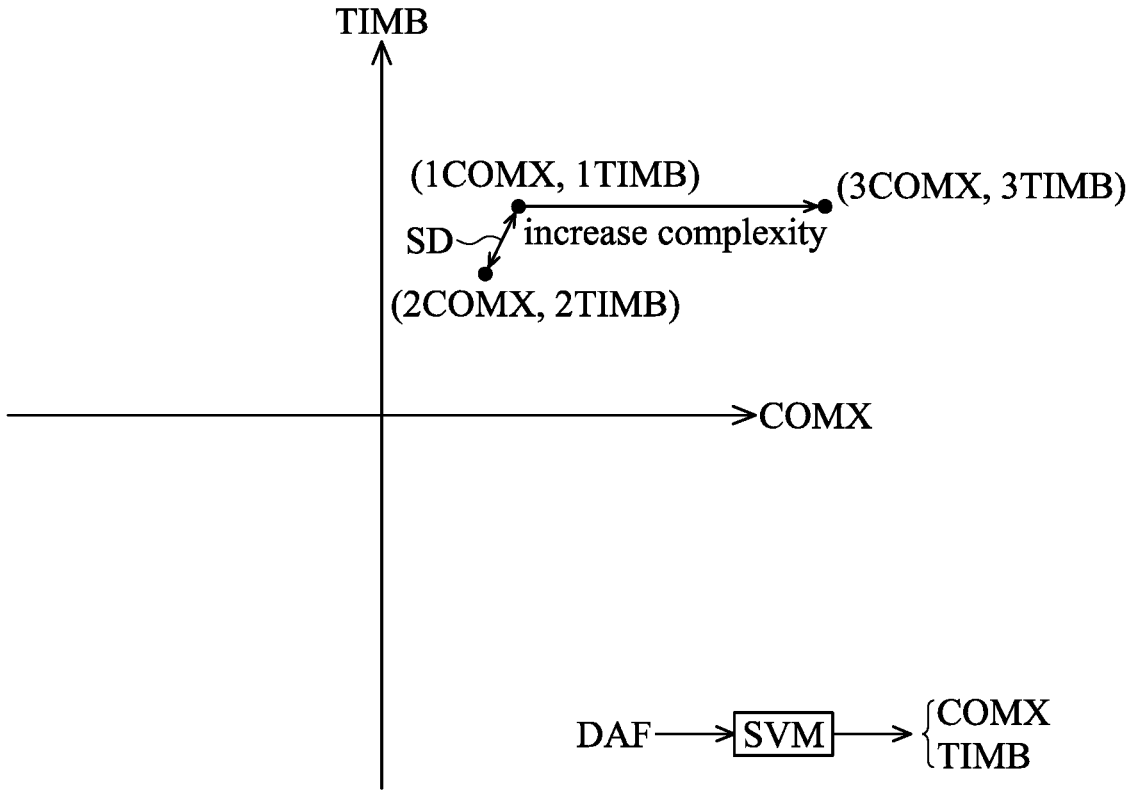
FIG. 2 is a schematic diagram showing two parameters used to generate the accompaniment pattern according to a preferred embodiment of the present disclosure.

Please refer to FIG. 2, which is a schematic diagram showing two parameters used to generate the accompaniment pattern DAP according to a preferred embodiment of the present disclosure. The horizontal axis represents a complexity COMX outputted from the support vector machine model SVM after the set of audio features DAP are analyzed, and the vertical axis represents a timbre TIMB outputted from the support vector machine model SVM after the set of audio features DAP are analyzed.

Please refer to FIGS. 1A, 1B and 2, in any one of the embodiments of the present disclosure, the at least two parts DAPP1, DAP2 include a first part drum pattern 1DP, a second part drum pattern 2DP and a third part drum pattern 3DP. The generation module 103 is further configured to perform the algorithm AG as follows: (A) obtain a pre-built database PDB including a plurality of drum patterns, each of which corresponds to a second complexity 2COMX and the second timbre 2TIMB; (B) select a plurality of candidate drum patterns PDP from the pre-built database PDB according to a similarity degree SD between the second complexity 2COMX and the second timbre 2TIMB and the first complexity 1COMX and the first timbre 1TIMB (or a distance between the two coordination point in FIG. 2), wherein each of the selected plurality of candidate drum patterns PDP has bass drum onsets ONS_BD1 and snare drum onsets ONS_SD1; (C) determine whether the onsets ONS of the set of audio features DAF should be kept or deleted according to the onset weights ONSW respectively, in order to obtain a processed onsets PONS1, and keeping fewer onsets if the first complexity 1COMX is low or the first timbre 1TIMB is soft, or keeping more onsets if the first complexity 1COMX is high or the first timbre 1TIMB is distorted; (D) compare the processed onsets PONS1 with the bass drum onsets ONS_BD1 and snare drum onsets ONS_SD1 of each of the selected plurality of candidate drum patterns PDP to give scores SCR respectively, and the more similar the bass drum onset ONS_BD1 and the snare drum onset ONS_SD1 to the processed onsets PONS1 results in the higher score; (E) select a first specific drum pattern CDP1 having a highest score SCR_H1 as the first part drum pattern 1DP; obtaining a third complexity 3COMX with complexity higher than that of the first complexity 1COMX; repeat sub-steps (B) to (D) using the third complexity 3COMX instead of the first complexity 1COMX, and determining a second specific drum pattern CDP2 having a highest score SCR_H2 as the second part drum pattern 2DP, but determining a third specific drum pattern CDP3 having a median score SCR_M as the third part drum pattern 3DP; adjust a sound volume of each of the first part drum pattern 1DP, the second part drum pattern 2DP and the third part drum pattern 3DP according to the first timbre 1TIMB, wherein the sound volume decreases when the first timbre 1TIMB approaches clean or neat, and the sound volume increases when the first timbre 1TIMB approaches dirty or distorted; and arranging the first part drum pattern 1DP, the second part drum pattern 2DP and the third part drum pattern 3DP according to a song structure for forming the accompaniment pattern DAP.

In any one of the embodiments of the present disclosure, the first, second and third part drum patterns 1DP, 2DP, 3DP can be a verse drum pattern, a chorus drum pattern and a bridge drum pattern respectively. The song structure can be any combinations of the first, second and third part drum patterns 1DP, 2DP, 3DP, and they can be repeated or continuous for the same drum pattern. Preferably, the song structure includes a specific combination of 1DP, 2DP, 3DP and 2DP.

In any one of the embodiments of the present disclosure, the accompaniment pattern DAP has a duration PDUR; and the generation module 103 is further configured to perform the followings: generate a first set of bass timing points 1BSTP according to the processed onsets PONS1 respectively in the duration PDUR; add a second set of bass timing points 2BSTP at the time point without the first set of bass timing points 1BSTP in the duration PDUR, wherein the second set of bass timing points 2BSTP is generated according to the processed bass drum onsets ONS_BD1 and the processed snare drum onsets ONS_SD1; and generate a bass pattern 1BSP having onsets on the first set of bass timing points 1BSTP and the second set of bass timing points 2BSTP, wherein the bass pattern 1BSP has notes, and pitches of the notes are determined based on a music theory with the chord information CHD. For the same token, another bass pattern 2BSP for the second part can be generated by the above similar method.

In any one of the embodiments of the present disclosure, the accompaniment pattern DAP is further obtained according to different generation types including at least one of a database type, a rule base type and a machine learning algorithm MLAG. For example, the database type is as the generation module 103 performs the above algorithm AG For example, the rule base type is as the analysis module 102 obtains at least one of a beat per minute BPM and a genre information GR for the musical pattern signal SMP when the user USR improvises some ad lib melodies. For example, by the machine learning algorithm MLAG, a trained model for generating the accompaniment DAP can be set up by inputting plural sets of onsets of an existing guitar rhythm pattern, existing drum pattern and existing bass pattern.

The present disclosure not only provides the user USR with the playing assistance information through an audio type information of accompaniment pattern DAP for playing sound signals, such as MIDI (musical instrument digital interface) information, but also provides the user USR with a visual type information for learning a song accompaniment, such as the chord indicating information ICHD. In addition, the song accompaniment may include effect settings applied to an instrument played in the existing music contents, and a mechanism used by the user USR can also be provided in the present disclosure to apply effect settings according to the existing musical contents.

Figure 3A:
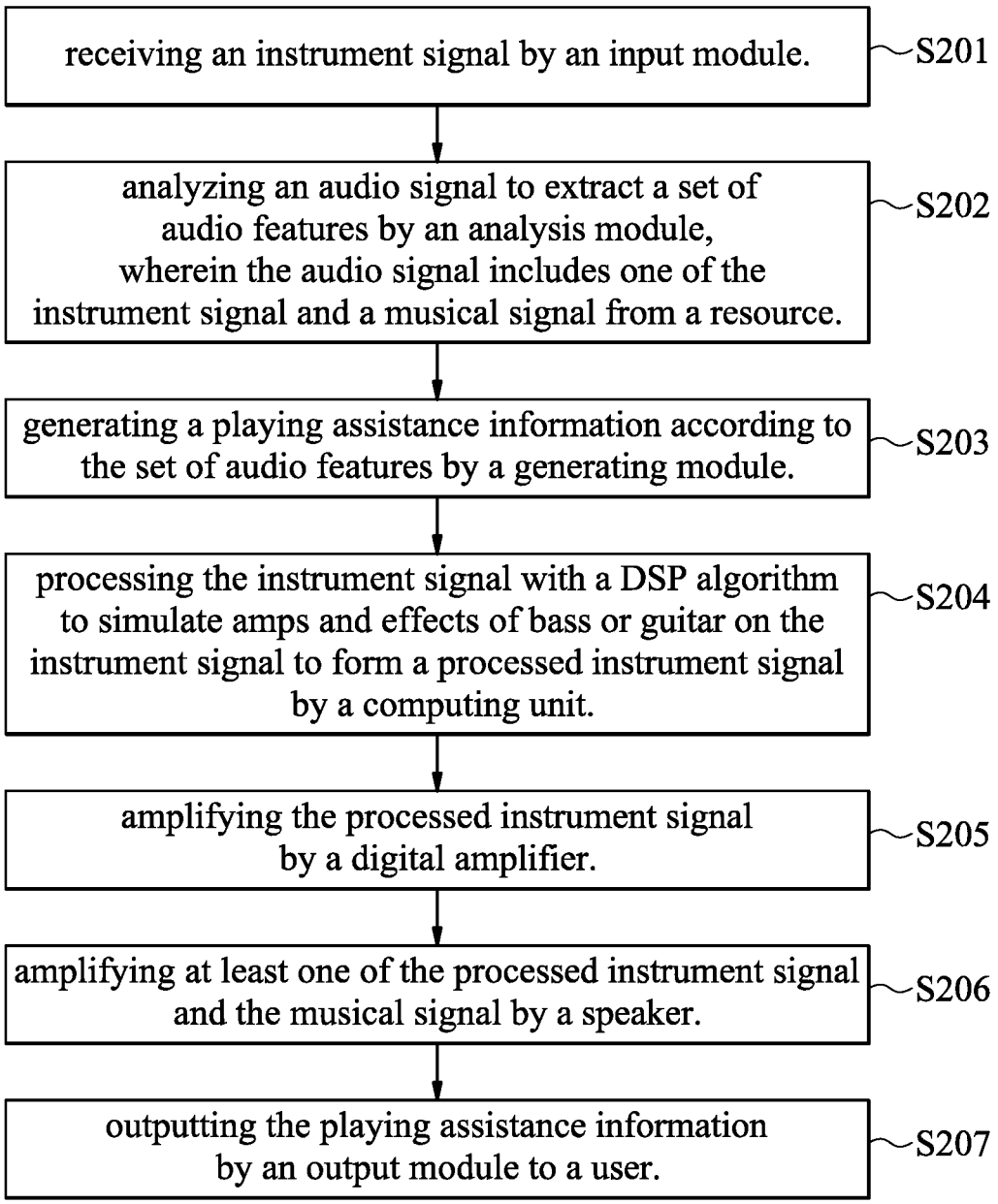
FIG. 3A is a schematic diagram showing a method for assisting a user to play an instrument in a system according to a preferred embodiment of the present disclosure.
Figure 3B:
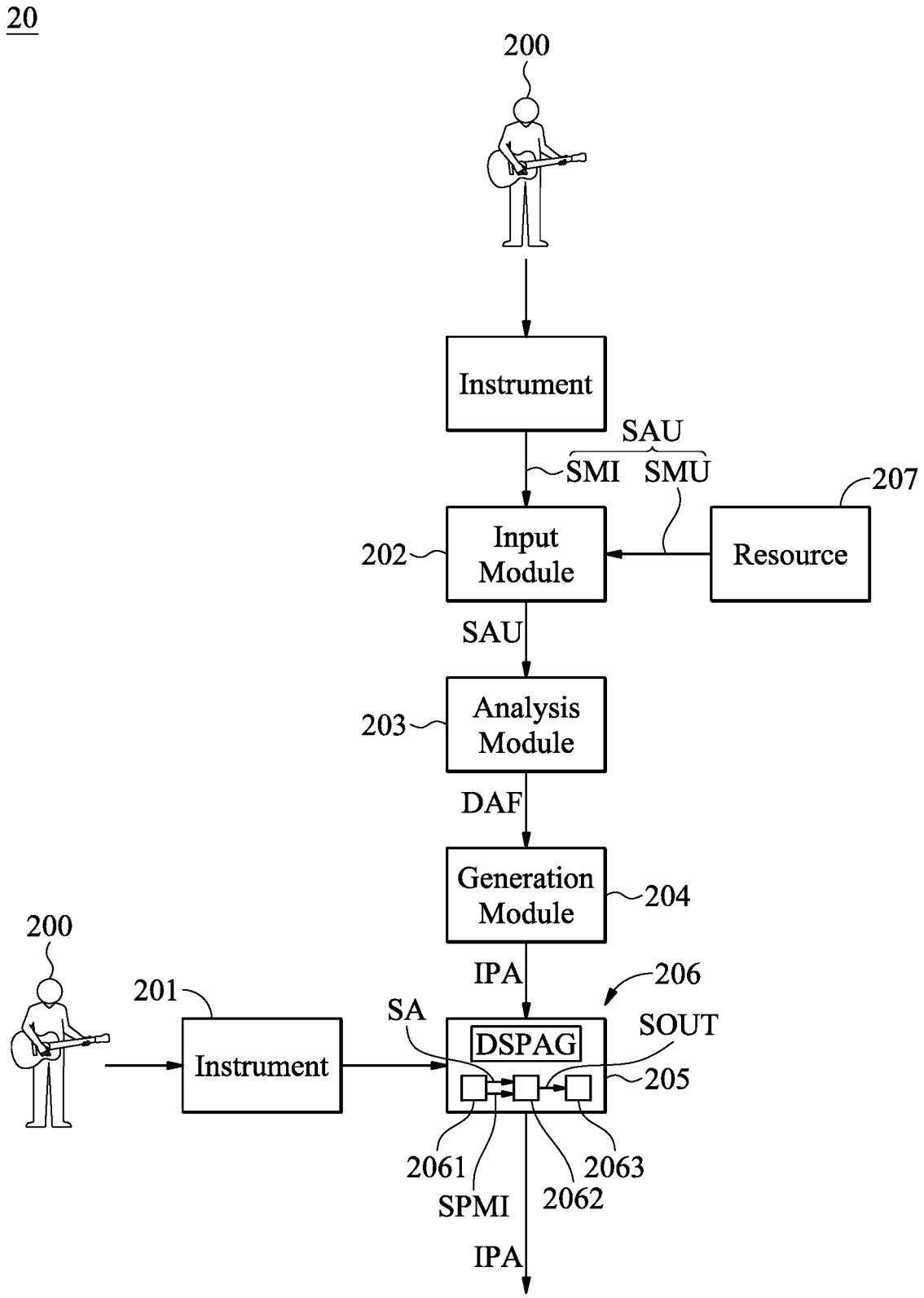
FIG. 3B is a schematic diagram showing the system according to a preferred embodiment of the present disclosure.

Please refer to FIGS. 3A and 3B, FIG. 3A is a schematic diagram showing a method S20 for assisting a user 200 to play an instrument 201 in a system 20 according to a preferred embodiment of the present disclosure, and FIG. 3B is a schematic diagram showing the system 20 according to a preferred embodiment of the present disclosure.

In any one of the embodiments of the present disclosure, the system 20 includes an input module 202, an analysis module 203, a generating module 204, an output module 205 and a musical equipment 206 having a computing unit 2061, a digital amplifier 2062 and a speaker 2063, for example, the speaker 2063 is a full-range speaker. The method S20 includes steps of: Step S201, receiving an instrument signal SMI by the input module 202; Step S202, analyzing an audio signal SAU to extract a set of audio features DAF by the analysis module 203, wherein the audio signal SAU includes one of the instrument signal SMI and a musical signal SMU from a resource 207; Step 203, generating a playing assistance information IPA according to the set of audio features DAF by the generating module 204; Step 204, processing the instrument signal with a DSP algorithm DSPAG to simulate amps and effects of bass or guitar on the instrument signal SMI to form a processed instrument signal SPMI by the computing unit 2061; Step 205, amplifying the processed instrument signal SPMI by the digital amplifier 2062; Step 206, amplifying at least one of the processed instrument signal SPMI and the musical signal SMU by the speaker 2063; and Step 207, outputting the playing assistance information IPA by the output module 205 to the user 200.

Please refer to FIGS. 1A, 1B, 2, 3A and 3B. In any one of the embodiments of the present disclosure, the resource 207 includes at least one selected from a group consisting of a website, a media service and a local storage. The set of audio features DAF includes a set of chord information CHD and at least one of an entropy ENP, onsets ONS, onset weights ONSW of the onsets ONS, a mel-frequency cepstral coefficients of a spectrum MFCC, a spectral complexity SCOMX, a roll off frequency of a spectrum ROFS, a spectral centroid SC, a spectral flatness SF, a spectral flux SX and a danceability DT, wherein each of the onset weights ONSW is calculated by a corresponding note volume NV and a corresponding note duration NDUR of the instrument signal SMI. The playing assistance information IPA includes a accompaniment pattern DAP and a chord indicating information ICHD, wherein the accompaniment pattern DAP has a beat pattern BP, and the chord indicating information ICHD is derived from the set of chord information CHD and includes at least one of a chord name, a finger chart, and a chord timing point. The system 20 further includes a cloud system 105 having a database PDB having a plurality of beat patterns PDP, for example, the database PDB is a pre-built database. The beat pattern BP of the accompaniment pattern DAP is generated by the cloud system 105 according to the set of audio features DAF, and corresponds to at least one of the plurality specific beat patterns PDP of the database PDB. For example, the beat pattern BP of the accompaniment pattern DAP is generated by the cloud system 105 according to a first complexity 1COMX and a first timbre 1TIMB of the set of audio features DAF.

In any one of the embodiments of the present disclosure, the input module 202 includes at least one of a mobile device MD and the musical equipment 206. When the mobile device MD functions as the input module 202, it can record the instrument signal SMI, or it can capture the musical signal SMU for the resource 207. In one embodiment, when the musical equipment 206 functions as the input module 202, it may have network components for transmitting the audio signal SAU to be connected to some device or some system (for example, the system 20 in FIG. 3B) to analyze and generate the accompaniment pattern DAP and the chord indicating information ICHD. In another embodiment, when the musical equipment 206 functions as the input module 202, it is not necessary to record and transmit the audio signal SAU, and it may have the analysis module 203 and the generation module 204 to analyze and generate the accompaniment pattern DAP and the chord indicating information ICHD. The output module 205 includes at least one of the mobile device MD, and the musical equipment 206. When the mobile device MD functions as the output module 205, it can display the chord indicating information ICHD on its screen to be seen for the user 200, and the user 200 can also listen to the accompaniment signal SA simultaneously by its built-in speaker (not shown) wherever derived from the instrument SMI or from the musical signal SMU. When the musical equipment 206 functions as the output module 205, it can display the chord indicating information ICHD on its screen to be seen for the user 200, and the user 200 can also listen to the accompaniment signal SA simultaneously by its built-in speaker 2063 wherever derived from the instrument SMI or from the musical signal SMU.

In any one of the embodiments of the present disclosure, the method S20 further includes steps of: receiving the instrument signal SMI by the input module 202, wherein the mobile device MD is connected with the musical equipment 206, the musical equipment 206 is connected with a musical instrument 201, and the instrument signal SMI is derived from a raw signal SR of the musical instrument 201 played by a user 200; inputting at least one of a beat per minute BPM, time signature TS, and a genre information GR for the instrument signal SMI into the analysis module 203 by the user 200 or automatically detecting the at least one of the bpm BPM, time signature TS, and the genre GR of the instrument signal SMI by the analysis module 203; transmitting the instrument signal SMI to the analysis module 203; detecting a global onset GONS of the instrument signal SMI to exclude a redundant sound RS before the global onset GONS; calculating a beat timing point BTP of each measure of the beat pattern BP of the accompaniment pattern DAP according to the bpm BPM and the time signature TS; determining the chord indicating information ICHD according to the set of chord information CHD and a chord algorithm CHDA; calculating an average value AVG of each of the set of audio features DAF in each measure of the musical signal SMU and the instrument signal SMI; and detecting the first complexity 1CONPX and the first timbre 1TIMB by inputting the average value AVG into a support vector machine model SVM). The step of transmitting the instrument signal SMI to the analysis module 203 includes compressing the instrument signal SMI into a compressed file to transmit to the analysis module 203. Alternatively, the musical equipment 206 or the mobile device MD can also directly transmit the instrument signal SMI to the analysis module 203.

In any one of the embodiments of the present disclosure, the cloud system 105 includes the analysis module 202 and the generating module 203. The beat pattern BP of the accompaniment pattern DAP is a drum pattern. The plurality of beat patterns PDP of the pre-built database PDB are a plurality of drum patterns PDP, each of which corresponds to a second complexity 2COMX and a second timbre 2TIMB.

In any one of the embodiments of the present disclosure, the method S20 further includes steps of: step (a): obtaining a database PDB including a plurality of drum patterns PDP, each of which corresponds to a second complexity 2COMX and a second timbre 2TIMB; step (b): selecting a plurality of candidate drum patterns PDP from the database PDB according to a specific relationship between the first complexity 1COMX and the first timbre 1TIMB and the second complexity 2COMX and the second timbre 2TIMB, wherein each of the selected plurality of candidate drum patterns PDP has at least one of bass drum onsets ONS_BD1 and snare drum onsets ONE_SD1; step (c): determining whether the onsets ONS of the set of audio features DAF should be kept or deleted according to the onset weights ONSW respectively, in order to obtain processed onsets PONS, said determining includes one of the following steps: keeping fewer onsets if the first complexity 1COMX is low or the first timbre 1TIMB is soft; and keeping more onsets if the first complexity 1COMX is high or the first timbre 1TIMB is noisy; step (d): comparing the processed onsets PONS with at least one of the bass drum onsets ONS_BD1 and snare drum onsets ONS_SD1 of each of the selected plurality of candidate drum patterns CDP1 to give scores SCR respectively, and the more similar the bass drum onset ONS_BS1 and the snare drum onset ONS_SD1 to processed onsets PONS results in the higher score; step (e): selecting a first specific drum pattern CDP1 having a highest score SCR_H1 as a first part drum pattern 1DP; obtaining a third complexity 3COMX with complexity higher than that of the first complexity 1COMX; repeating steps (b), (c), (d) using the third complexity 3COMX instead of the first complexity 1COMX and determining a second specific drum pattern CDP2 having a highest score SCR_H2 from the selected plurality of candidate drum patterns PDP as a second part drum pattern 2DP but determining a third specific drum pattern CDP3 having a median score SCR_M as a third part drum pattern 3DP; adjusting a sound volume of each of the first part drum pattern 1DP, the second part drum pattern 2DP and the third part drum pattern 3DP according to the first timbre 1TIMB, wherein the sound volume decreases when the first timbre 1TIMB approaches clean or neat, and the sound volume increases when the first timbre 1TIMB approaches dirty or noisy; arranging the first part drum pattern 1DP, the second part drum pattern 2DP and the third part drum pattern 3DP for obtaining the drum pattern of the accompaniment pattern DAP.

In any one of the embodiments of the present disclosure, the method S20 further includes steps of performing a bass pattern generating methods, wherein the bass pattern generating method includes steps of: pre-building a plurality of bass patterns PBP in the database PDB, wherein the plurality of bass patterns PBP includes at least one of a first bass pattern P1BSP, a second bass pattern P2BSP and a third bass pattern P3BSP; corresponding the first bass pattern P1BSP, the second bass pattern P2BSP and the third bass pattern P3BSP to the first part drum pattern 1DP, the second part drum pattern 2DP and the third part drum pattern 3DP respectively. Specifically, generating a first set of bass timing points 1BSTP according to the processed onsets PONS respectively in the duration PDDR corresponding to the first part drum pattern 1DP, the second drum pattern 2DP and the third drum pattern 3DP; adding a second set of bass timing points 2BSTP at the time point without the first set of bass timing points 1BSTB in the duration PDDR, wherein the second set of bass timing points 2BSTP is generated according to the at least one of the bass drum onsets ONST_BD1 and the snare drum onsets ONS_SD1 of the first part drum pattern 1DP, the second part drum pattern 2DP and the third part drum pattern 3DP. For example, if the bass drum onsets ONST_BD1 and the snare drum onsets ONS_SD1 of the first drum pattern have a specific timing point corresponding to no timing point of the processed onsets used to generate the first drum pattern; then add a bass timing point at the specific timing point. Next, generating a first part bass pattern 1BSP having onsets ONS at the corresponding time points of first set of bass timing points 1BSTP and the second set of bass timing points 2BSTP, wherein the first part bass pattern 1BSP at least partially corresponds to the first bass pattern P1BSP and has notes and pitches of the notes are determined based on a music theory with the chord information CHD. Similarly, a second part pattern 2BSP and a third part bass pattern 3BSP can be also generated by the same way as that of the first part bass pattern 1BSP, wherein the second part bass pattern 2BSP and the third part bass pattern 3BSP are at least partially corresponds to the second bass pattern P2BSP and the third bass pattern P3BSP respectively.

Figure 4:
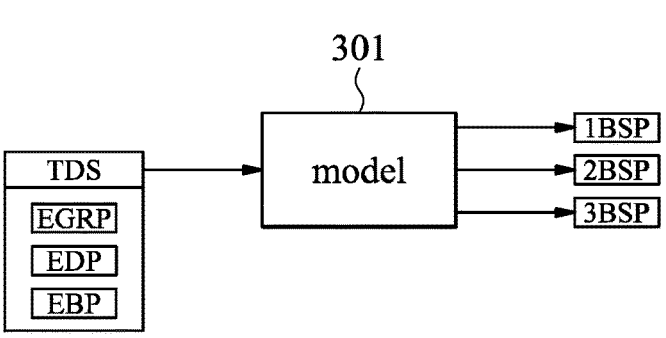
FIG. 4 is a schematic diagram showing a model trained by training datasets according to a preferred embodiment of the present disclosure.

Please refer to FIG. 4, which is a schematic diagram showing a model 301 trained by the AI method according to a preferred embodiment of the present disclosure. In any one of the embodiments of the present disclosure, the method S20 further includes an AI method to generate a first and a second bass pattern, the AI method includes steps of: generating a model 301 by a machine learning method, wherein training datasets TDS used by the machine learning method includes plural sets of onsets ONS of an existing guitar rhythm pattern, existing drum pattern and existing bass pattern; and generating a first part bass pattern 1BSP having notes, wherein time points of the notes are determined by inputting the onsets ONS of the musical pattern signal SMP, the first part drum pattern 1DP, the second part drum pattern 2DP, and the third part drum pattern 3DP into the model and pitches of the notes are determined based on a music theory. A second part and third part bass patterns 2BSP, 3BSP can also be generated by the same method.

In any one of the embodiments of the present disclosure, the musical signal SMU is associated with a database PDB having plural sets of pre-build chord information PCHD including the set of chord information CHD of the musical signal SMU. The cloud system 105 or the output module 205 provides the user 200 with the playing assistance information IPA having a difficulty level according to the user's skill level.

Figure 5:
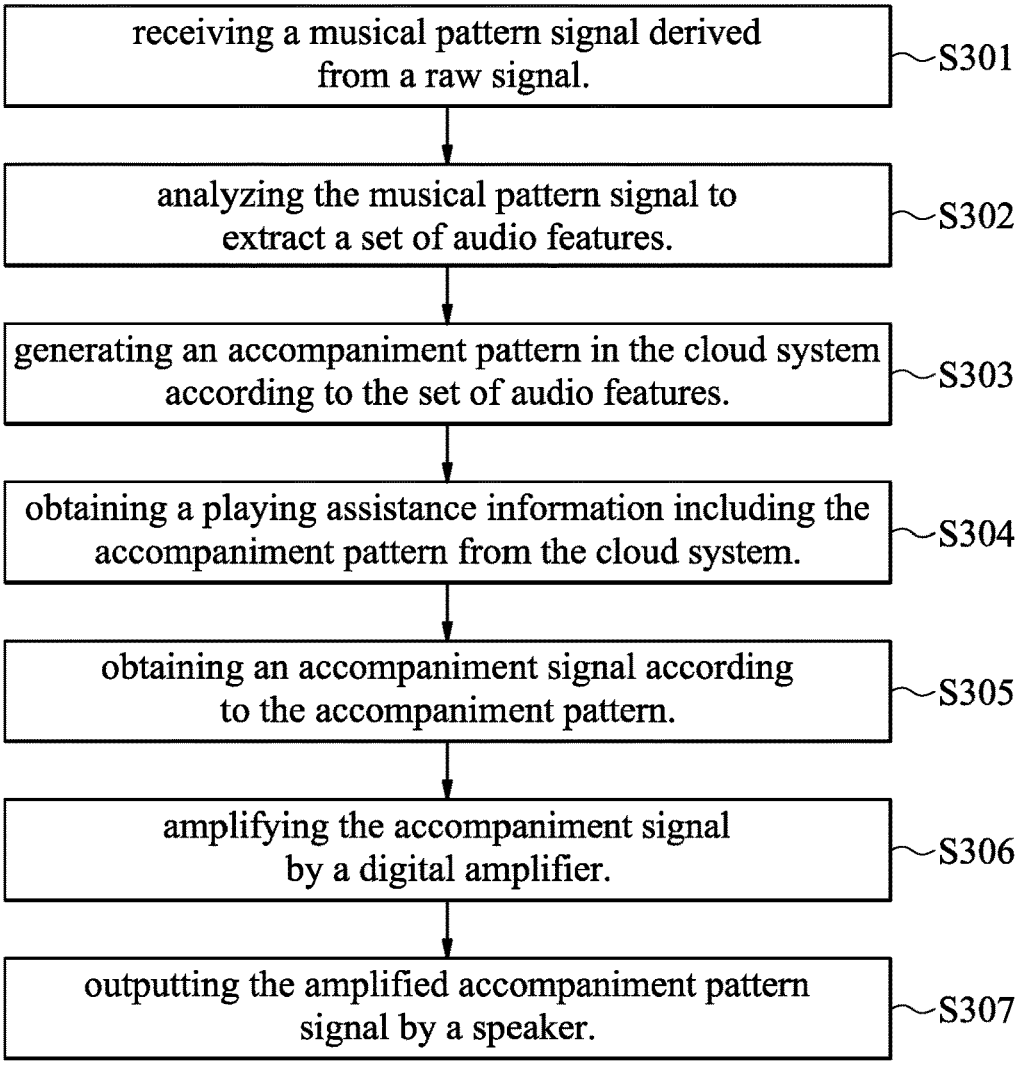
FIG. 5 is a schematic diagram showing a method for assisting a user to play an instrument in an accompaniment generating system according to a preferred embodiment of the present disclosure.

Please refer to FIG. 5, which is a schematic diagram showing a method S30 for assisting a user USR to play an instrument MI in an accompaniment generating system 10 according to a preferred embodiment of the present disclosure. The accompaniment generating system 10 includes a cloud system 105, and the method S30 includes steps of: step S301, receiving a musical pattern signal SMP derived from a raw signal SR; step S302, analyzing the musical pattern signal SMP to extract a set of audio features DAF; step S303, generating an accompaniment pattern DAP in the cloud system 105 according to the set of audio features DAF; and step S304, obtaining a playing assistance information IPA including the accompaniment pattern DAP from the cloud system 105.

In any one of the embodiments of the present disclosure, the accompaniment generating system 10 further includes at least one of a mobile MD and a musical equipment 104, wherein the set of audio features DAF include onsets ONS and chord information CHD. The accompaniment pattern DAP is generated according to the onsets ONS and chord information CHD of the set of audio features DAF. The method S30 further includes steps of: obtaining an accompaniment signal SA according to the accompaniment pattern DAP; amplifying the accompaniment signal SA by a digital amplifier 1041, 2062; and outputting the amplified accompaniment pattern signal SOUT by a speaker 2063. The method S30 further includes steps of: inputting at least one of a beat per minute BPM, time signature TS and a genre information GR into the mobile device MD by a user USR, or automatically detecting the at least one of the bpm BMP, time signature TS and the genre GR by the cloud system 105, wherein the raw signal SR is generated by a musical instrument MI played by the user USR and the accompaniment pattern DAP includes at least one of a beat pattern BP and a chord pattern CP; receiving the musical pattern signal SMP by the musical equipment 104 or by the mobile device MD, wherein the mobile device MD is connected with the musical equipment 104, the musical equipment 104 is connected with the musical instrument MI, and the musical pattern signal SMP is transmitted to the cloud system 105 by the mobile device MD or the musical equipment 104. In some embodiment, the musical pattern signal SMP is compressed into a compressed musical pattern signal with a compressed format so as to be transmitted to the cloud system 105.

In any one of the embodiments of the present disclosure, the method S30 further includes steps of: detecting a global onset GONS of the musical pattern signal SMP to exclude a redundant sound RS before the global onset GONS; and calculating a beat timing point BTP of each measure of the accompaniment pattern DAP according to the bpm BPM and the time signature TS.

In any one of the embodiments of the present disclosure, the set of audio features DAF includes at least one of an entropy ENP, onsets ONS, onset weights ONSW of the onsets ONS, a mel-frequency cepstral coefficients of a spectrum MFCC, a spectral complexity SC, a roll off frequency of a spectrum ROFS, a spectral centroid SC, a spectral flatness SF, a spectral flux SX and a danceability DT. Each of the onset weights ONSW is calculated by a corresponding note volume NV and a corresponding note duration NDUR of the musical pattern signal SMP. The method S30 further includes steps of: calculating an average value AVG of each of the set of audio features DAF in each measure of the musical pattern signal SMP; and determining a first complexity 1COMX and a first timbre 1TIMB by inputting the average value AVG into a support vector machine model SVM.

In any one of the embodiments of the present disclosure, a first complexity 1COMX and a first timbre 1TIMB are derived from the set of audio features DAF and the set of audio features DAF include onsets ONS and onset weights ONSW of the onsets ONS. The method S30 further includes sub-steps of: sub-step (a): obtaining a database PDB including a plurality of drum patterns PDP, each of which corresponds to a second complexity 2COMX and a second timbre 2TIMB; sub-step (b): selecting a plurality of candidate drum patterns CDP1 from the database PDB according to a similarity degree SD between the second complexity 2COMX and the second timbre 2TIMB and the first complexity 1COMX and the first timbre 1TIMB (for example, a distance between the two coordination point in FIG. 2), wherein each of the selected plurality of candidate drum patterns PDP has at least one of bass drum onsets ONS_BD1 and snare drum onsets ONS_SD1; sub-step (c): determining whether the onsets ONS of the set of audio features DAF should be kept or deleted according to the onset weights ONSW respectively, in order to obtain processed onsets PONS1, said determining includes one of the following steps: keeping fewer onsets ONS if the first complexity 1COMX is low or the first timbre 1TIMB is soft; and keeping more onsets ONS if the first complexity 1COMX is high or the first timbre 1TIMB is distorted; sub-step (d): comparing the processed onsets PONS1 with the at least one of the bass drum onsets ONS_BD1 and the snare drum onsets ONS_SD1 of each of the selected plurality of candidate drum patterns PDP to give scores SCR respectively, and the more similar the at least one of the bass drum onsets ONS_BD1 and the snare drum onsets ONS_SD1 to the processed onsets PONS1 results in the higher score; and sub-step (e): selecting a first specific drum pattern CDP1 having a highest score SCR_H1 as a first part drum pattern 1DP.

In any one of the embodiments of the present disclosure, the method S30 further includes steps of: obtaining a third complexity 3COMX with complexity higher than that of the first complexity 1COMX; repeating steps (b), (c), (d) using the third complexity 3COMX instead of the first complexity 1COMX and determining a second specific drum pattern CDP2 having a highest score SCR_H2 from the selected plurality of candidate drum patterns PDP as a second part drum pattern 2DP but determining a third specific drum pattern CDP3 having a median score SCR_M as a third part drum pattern 3DP; adjusting a sound volume of each of the first part drum pattern 1DP, the second part drum pattern 2DP and the third part drum pattern 3DP according to the first timbre 1TIMB, wherein the sound volume decreases when the first timbre 1TIMB approaches clean or neat, and the sound volume increases when the first timbre 1TIMB approaches dirty or noisy; arranging the first part drum pattern 1DP, the second part drum pattern 2DP and the third part drum pattern 3DP for obtaining the drum pattern of the accompaniment pattern DAP.

In any one of the embodiments of the present disclosure, the first, second and third part drum patterns 1DP, 2DP, 3DP can be a verse drum pattern, a chorus drum pattern and a bridge drum pattern respectively. The song structure can be any combination of the first, second and third part drum patterns 1DP, 2DP, 3DP, and they can be repeated or continuous for the same drum pattern. Preferably, the song structure includes a specific combination of 1DP, 2DP, 3DP and 2DP.

In any one of the embodiments of the present disclosure, the method S30 further includes steps of: pre-building a plurality of bass patterns PBP in the database PDB, wherein the plurality of bass patterns PBP includes at least one of a first bass pattern P1BSP, a second bass pattern P2BSP and a third bass pattern P3BSP; corresponding the first bass pattern P1BSP, the second bass pattern P2BSP and the third bass pattern P3BSP to the first part drum pattern 1DP, the second part drum pattern 2DP and the third part drum pattern 3DP respectively; generating a first set of bass timing points 1BSTP according to the processed onsets PONS respectively in the duration PDUR; adding a second set of bass timing points 2BSTP at the time point without the first set of bass timing points 1BSTB in the duration PDUR, wherein the second set of bass timing points 2BSTP is generated according to the processed bass drum onsets ONST_BD1 and the processed snare drum onsets ONS_SD1. For example, if the bass drum onsets ONST_BD1 and the snare drum onsets ONS_SD1 of the first drum pattern have a specific timing point corresponding to no timing point of the processed onsets used to generate the first drum pattern; then add a bass timing point at the specific timing point. Next, generating a first part bass pattern 1BSP having onsets ONS on the first set of bass timing points 1BSTP and the second set of bass timing points 2BSTP, wherein the first part bass pattern 1BSP at least partially corresponds to the first bass pattern P1BSP and has notes and pitches of the notes are determined based on a music theory with the chord information CHD. Similarly, a second part bass pattern 2BSP and the third part bass pattern 3BSP can be also generated by the same way as that of the first part bass pattern 1BSP, wherein the second part bass pattern 2BSP and the third part bass pattern 3BSP are at least partially corresponds to the second bass pattern P2BSP and the third bass pattern P3BSP respectively.

In any one of the embodiments of the present disclosure, the method S30 further includes an AI method to generate a first and a second bass pattern. The AI method includes steps of: generating a model 301 by a machine learning method, wherein training dataset used by the machine learning method includes plural sets of onsets ONS of an existing guitar rhythm pattern, existing drum pattern and existing bass pattern; and generating a first part bass pattern 1BSP having notes, wherein time points of the notes are determined by inputting the onsets ONS of the musical pattern signal SMP, the first part drum pattern 1DP, the second part drum pattern 2DP, and the third part drum pattern 3DP into the model and pitches of the notes are determined based on a music theory. A second part and third part bass patterns 2BSP, 3BSP can also be generated by the same method.

In any one of the embodiments of the present disclosure, the musical signal SMU is associated with a database PDB having plural sets of pre-build chord information PCHD including the set of chord information CHD of the musical signal SMU. The cloud system 105 or the output module 205 provides the user 200 with the playing assistance information IPA having a difficulty level according to the user's skill level.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A method for assisting a user to play an instrument in a system including an input module, an analysis module, a generating module, an output module and a musical equipment having a computing unit, a digital amplifier and a speaker, the method comprising steps of:

receiving an instrument signal by the input module;

analyzing an audio signal to extract a set of audio features by the analysis module, wherein the audio signal includes one of the instrument signal and a musical signal from a resource;

generating a playing assistance information according to the set of audio features by the generating module;

processing the instrument signal with a DSP algorithm to simulate amps and effects of bass or guitar on the instrument signal to form a processed instrument signal by the computing unit;

amplifying the processed instrument signal by the digital amplifier;

amplifying at least one of the processed instrument signal and the musical signal by the speaker; and outputting the playing assistance information by the output module to the user, wherein:

the playing assistance information includes an accompaniment pattern;

the set of audio features of the musical signal includes a set of chord information;

the resource includes at least one of a website, media service and local storage;

the system further includes a cloud system;

the musical signal is associated with a database having plural sets of pre-build chord information including the set of chord information of the musical signal; and the cloud system or the output module provides the user with the playing assistance information having a difficulty level according to the user's skill level.

2. The method as claimed in claim 1, wherein:

the cloud system has the database having a plurality of beat patterns;

a beat pattern of the accompaniment pattern is generated by the cloud system according to the set of audio features and corresponds to at least one of the plurality specific beat patterns of the database; and the input module includes at least one of a mobile device and the musical equipment.

3. The method as claimed in claim 2, wherein:

the set of audio features includes the set of chord information and at least one of an entropy, onsets, onset weights of the onsets, a mel-frequency cepstral coefficients of a spectrum (mfcc), a spectral complexity, a roll off frequency of a spectrum, a spectral centroid, a spectral flatness, a spectral flux and a danceability;

the playing assistance information further includes a chord indicating information, wherein the accompaniment pattern has a beat pattern, and the chord indicating information is derived from the set of chord information and includes at least one of a chord name, finger chart, and a chord timing point;

the cloud system includes the analysis module and the generating module;

the beat pattern of the accompaniment pattern is a drum pattern;

the plurality of beat patterns of the database are a plurality of drum patterns; and the method further comprising steps of:

receiving the instrument signal by the input module, wherein the mobile device is connected with the musical equipment, the musical equipment is connected with a musical instrument, and the instrument signal is derived from a raw signal of the musical instrument;

inputting at least one of a beat per minute (bpm), time signature, and a genre information from the instrument signal into the analysis module by the user or automatically detecting the at least one of the bpm, time signature, and the genre of the instrument signal by the analysis module;

transmitting the instrument signal to the analysis module;

detecting a global onset of the instrument signal to exclude a redundant sound before the global onset;

calculating a beat timing point of each measure of the beat pattern of the accompaniment pattern according to the bpm and the time signature; and determining the chord indicating information according to the set of chord information and a chord algorithm.

4. The method as claimed in claim 1, wherein:

the playing assistance information is generated according to the set of chord information; and the playing assistance information is displayed by the output module including a mobile device or the musical equipment.

5. An intelligent accompaniment generating system, comprising:

an input module configured to receive a musical pattern signal derived from a raw signal;

an analysis module configured to:

analyze the musical pattern signal to extract a set of audio features, wherein the input module is configured to transmit the musical pattern signal to the analysis module;

a generation module configured to obtain a playing assistance information having an accompaniment pattern from the analysis module, wherein the accompaniment pattern has at least two parts having different onsets therebetween, and each onsets of the at least two parts is generated according to the set of audio features;

a musical equipment including a digital amplifier configured to output an accompaniment signal according to the accompaniment pattern; and a cloud system, wherein:

the set of audio features of the musical pattern signal includes a set of chord information;

the musical pattern signal is associated with a database having plural sets of pre-build chord information including the set of chord information of the musical pattern signal; and the cloud system or the music equipment provides a user with the playing assistance information having a difficulty level according to the user's skill level.

6. The intelligent accompaniment generating system as claimed in claim 5, wherein:

the accompaniment pattern is outputted by the generation module and generated according to onsets and the set of chord information of the set of audio features;

the playing assistance information includes the accompaniment pattern and a chord indicating information, wherein the accompaniment pattern has a beat pattern, and the chord indicating information is derived from the set of chord information and includes at least one of a chord name, finger chart, and a chord timing point;

the input module is implemented on a mobile device or the musical equipment for receiving the musical pattern signal, and the musical equipment connects to at least one of the mobile device and a musical instrument, wherein the musical pattern signal is derived from a raw signal of the musical instrument played by the user;

the analysis module obtains at least one of a beat per minute (bpm) and a genre information from the musical pattern signal, or automatically detects the at least one of the bpm and the genre of the musical pattern signal by the analysis module; and the musical pattern signal is transmitted to the cloud system including the analysis module and the generation module.

7. The intelligent accompaniment generating system as claimed in claim 5, wherein:

the analysis module detects a beat per minute (bpm) and a time signature in the set of audio features, detects a global onset of the musical pattern signal to exclude a redundant sound before the global onset, calculates a beat timing point of each measure of the accompaniment pattern according to the bpm and the time signature; and determines a chord used in the musical pattern signal and a chord timing point according to the set of chord information and a chord algorithm.

8. The intelligent accompaniment generating system as claimed in claim 5, wherein:

the analysis module obtains the set of audio features including at least one of an entropy, onsets, onset weights of the onsets, a mel-frequency cepstral coefficients of a spectrum (mfcc), a spectral complexity, a roll off frequency of a spectrum, a spectral centroid, a spectral flatness, a spectral flux and a danceability, the analysis module calculates an average value of each of the set of audio features in each measure of the musical pattern; and the analysis module determines the first complexity and the first timbre by inputting the average value into a support vector machine (SVM) model.

9. The intelligent accompaniment generating system as claimed in claim 8, wherein:

the at least two parts include a first part drum pattern, a second part drum pattern and a third part drum pattern; and the generation module is further configured to:

(A) obtain the database including a plurality of drum patterns, each of which corresponds to a second complexity and a second timbre;

(B) select a plurality of candidate drum patterns from the database according to a similarity degree between the second complexity and the second timbre and the first complexity and the first timbre, wherein each of the selected plurality of candidate drum patterns has at least one of bass drum onsets and snare drum onsets;

(C) determine whether the onsets of the set of audio features should be kept or deleted according to the onset weights respectively, in order to obtain processed onsets, and keeping fewer onsets if the first complexity is low or the first timbre is soft, or keeping more onsets if the first complexity is high or the first timbre is distorted;

(D) compare the processed onsets with the at least one of bass drum onsets and snare drum onsets of each of the selected plurality of candidate drum patterns to give scores respectively, and the more similar the bass drum onset and the snare drum onset to the processed onsets results in the higher score;

(E) select a first specific drum pattern having a highest score as the first part drum pattern;

obtaining a third complexity with complexity higher than that of the first complexity;

repeat sub-steps (B) to (D) using the third complexity instead of the first complexity, and determining a second specific drum pattern having a highest score as the second part drum pattern, but determining a third specific drum pattern having a median score as the third part drum pattern;

adjust a sound volume of each of the first part drum pattern, the second part drum pattern and the third part drum pattern according to the first timbre, wherein the sound volume decreases when the first timbre approaches clean or neat, and the sound volume increases when the first timbre approaches dirty or distorted; and arranging the first part drum pattern, the second part drum pattern and the third part drum pattern according to a song structure for forming the accompaniment pattern.

10. The intelligent accompaniment generating system as claimed in claim 9, wherein:

the accompaniment pattern has a duration; and the generation module is further configured to:

generate a first set of bass timing points according to the processed onsets respectively in the duration corresponding to the first part drum pattern, the second part drum pattern and the third part drum pattern;

add a second set of bass timing points at the time point without the first set of bass timing points in the duration, wherein the second set of bass timing points is generated according to the at least one of the bass drum onsets and the snare drum onsets of the first part drum pattern, the second part drum pattern and the third part drum pattern; and generate a bass pattern having onsets on the first set of bass timing points and the second set of bass timing points, wherein the bass pattern has notes and pitches of the notes are determined based on a music theory with the set of chord information.

11. A method for assisting a user to play an instrument in an accompaniment generating system, including a cloud system, and the method comprising steps of:

receiving a musical pattern signal derived from a raw signal;

analyzing the musical pattern signal to extract a set of audio features;

generating an accompaniment pattern in the cloud system according to the set of audio features;

obtaining a playing assistance information including the accompaniment pattern from the cloud system;

obtaining an accompaniment signal according to the accompaniment pattern;

amplifying the accompaniment signal by a digital amplifier;

outputting the amplified accompaniment signal by a speaker, wherein:

the set of audio features of the musical pattern signal includes a set of chord information;

the musical pattern signal is associated with a database having plural sets of pre-build chord information including the set of chord information of the musical pattern signal; and the cloud system provides the user with the playing assistance information having a difficulty level according to the user's skill level.

12. The method as claimed in claim 11, wherein:

the accompaniment generating system further includes at least one of an analysis mobile device and a musical equipment, wherein the set of audio features include onsets and the set of chord information;

the method further comprising steps of:

inputting at least one of a beat per minute (bpm), time signature and a genre information into the analysis module by a user, or automatically detecting the at least one of the bpm, time signature and the genre, wherein the raw signal is generated by a musical instrument played by the user, and the accompaniment pattern includes at least one of a beat pattern and a chord pattern;

receiving the musical pattern signal by the musical equipment or by the mobile device, wherein the mobile device is connected with the musical equipment, the musical equipment is connected with the musical instrument, and the musical pattern signal is transmitted to the cloud system by the mobile device or the musical equipment; and transmitting the musical pattern signal to the cloud system.

13. The method as claimed in claim 11, further comprising steps of:

detecting a global onset of the musical pattern signal to exclude a redundant sound before the global onset; and calculating a beat timing point of each measure of the accompaniment pattern according to the bpm and the time signature.

14. The method as claimed in claim 11, wherein:

the set of audio features including at least one of an entropy, onsets, onset weights of the onsets, a mel-frequency cepstral coefficients of a spectrum (mfcc), a spectral complexity, a roll off frequency of a spectrum, a spectral centroid, a spectral flatness, a spectral flux and a danceability; and the method further comprising steps of:

calculating an average value of each of the set of audio features in each measure of the musical pattern signal; and determining a first complexity and a first timbre by inputting the average value into a support vector machine (SVM) model.

15. The method as claimed in claim 11, wherein a first complexity and a first timbre are derived from the set of audio features and the set of audio features include onsets and onset weights of the onsets, the method further comprising sub-steps of:

(A) obtaining the database including a plurality of drum patterns, each of which corresponds to a second complexity and a second timbre;

(B) selecting a plurality of candidate drum patterns from the database according to a similarity degree between the second complexity and the second timbre and the first complexity and the first timbre, wherein each of the selected plurality of candidate drum patterns has at least one of bass drum onsets and snare drum onsets;

(C) determining whether the onsets of the set of audio features should be kept or deleted according to the onset weights respectively, in order to obtain a processed onsets, and keeping fewer onsets if the first complexity is low or the first timbre is soft, or keeping more onsets if the first complexity is high or the first timbre is distorted;

(D) comparing the processed onsets with the at least one of bass drum onsets and snare drum onsets of each of the selected plurality of candidate drum patterns to give scores respectively, and the more similar the at least one of the bass drum onset and the snare drum onset to the processed onsets results in the higher score;

(E) selecting a first specific drum pattern having a highest score as the first part drum pattern.

16. The method as claimed in claim 15, further comprising steps of:

obtaining a third complexity with complexity higher than that of the first complexity;

repeat sub-steps (B) to (D) using the third complexity instead of the first complexity, and determining a second specific drum pattern having a highest score as the second part drum pattern, but determining a third specific drum pattern having a median score as the third part drum pattern;

adjust a sound volume of each of the first part drum pattern, the second part drum pattern and the third part drum pattern according to the first timbre, wherein the sound volume decreases when the first timbre approaches clean or neat, and the sound volume increases when the first timbre approaches dirty or distorted; and arranging the first part drum pattern, the second part drum pattern and the third part drum pattern according to a song structure for forming the accompaniment pattern.

17. The method as claimed in claim 16, further comprising steps of:

pre-building a plurality of bass patterns in the database, wherein the plurality of bass patterns includes at least one of a first bass pattern, a second bass pattern and a third bass pattern; and corresponding the first bass pattern, the second bass pattern and the third bass pattern to the first part drum pattern, the second part drum pattern and the third part drum pattern respectively.

18. The method as claimed in claim 16, wherein the musical pattern signal has a duration, the set of audio features includes the set of chord information, and the method further comprising sub-steps of:

generating a first set of bass timing points according to the processed onsets respectively in the duration;

adding a second set of bass timing points at the time point without the first set of bass timing points in the duration, wherein the second set of bass timing points is generated according to the processed bass drum onsets and the processed snare drum onsets; and generating a bass pattern having onsets on the first set of timing points and the second set of timing points, wherein the bass pattern has notes and pitches of the notes are determined based on a music theory with the set of chord information.

19. The method as claimed in claim 11, further comprising sub-steps of:

generating a model by a machine learning method, wherein training dataset used by the machine learning method includes plural sets of onsets of an existing guitar rhythm pattern, existing drum pattern and existing bass pattern; and generating a bass pattern having notes, wherein time points of the notes are determined by inputting the onsets of the musical pattern signal, the first part drum pattern, the second part drum pattern, and the third part drum pattern into the model and pitches of the notes are determined based on a music theory.

* * * * *